US011420229B2

(12) United States Patent
Pankoke

(10) Patent No.: US 11,420,229 B2
(45) **Date of Patent: *Aug. 23, 2022**

(54) METHOD AND APPARATUS FOR PRODUCING A DECORATIVE SURFACE

(71) Applicant: Hymmen GmbH Maschinen—und Anlagenbau, Bielefeld (DE)

(72) Inventor: René Pankoke, Bielefeld (DE)

(73) Assignee: Hymmen GmbH Maschinen—und Anlagenbau, Bielefeld (DE)

( * ) Notice: Subject to any disclaimer, the term of this patent is extended or adjusted under 35 U.S.C. 154(b) by 334 days.

This patent is subject to a terminal disclaimer.

(21) Appl. No.: 16/494,309

(22) PCT Filed: Jun. 13, 2018

(86) PCT No.: PCT/EP2018/065731

§ 371 (c)(1),
(2) Date: Sep. 16, 2019

(87) PCT Pub. No.: WO2018/229164

PCT Pub. Date: Dec. 20, 2018

(65) Prior Publication Data

US 2020/0016629 A1 Jan. 16, 2020

(30) Foreign Application Priority Data

| | | |
|---|---|---|
| Jun. 13, 2017 | (DE) | 10 2017 113 035.7 |
| Jun. 13, 2017 | (DE) | 10 2017 113 036.5 |
| Feb. 19, 2018 | (EP) | 18157511 |
| Mar. 14, 2018 | (EP) | 18161725 |
| Mar. 16, 2018 | (EP) | 18162382 |
| Apr. 19, 2018 | (EP) | 18168263 |

(51) Int. Cl.

| | |
|---|---|
| ***B05D 3/12*** | (2006.01) |
| ***B05D 3/06*** | (2006.01) |
| ***B05D 5/02*** | (2006.01) |
| ***B05D 7/00*** | (2006.01) |
| ***B41M 7/00*** | (2006.01) |
| ***B44C 3/02*** | (2006.01) |
| ***B41F 23/08*** | (2006.01) |
| ***B41M 3/06*** | (2006.01) |
| ***B41M 5/00*** | (2006.01) |
| ***B05D 3/00*** | (2006.01) |
| ***B05D 3/04*** | (2006.01) |
| ***B41J 11/00*** | (2006.01) |
| ***B44C 5/04*** | (2006.01) |
| ***B44F 1/02*** | (2006.01) |
| ***B44F 9/02*** | (2006.01) |

(Continued)

(52) U.S. Cl.

CPC ..... *B05D 3/12* (2013.01); *B05D 3/002* (2013.01); *B05D 3/0486* (2013.01); *B05D 3/067* (2013.01); *B05D 5/02* (2013.01); *B05D 7/584* (2013.01); *B41F 23/08* (2013.01); *B41J 11/002* (2013.01); *B41J 11/0015* (2013.01); *B41M 3/06* (2013.01); *B41M 5/0047* (2013.01); *B41M 7/0027* (2013.01); *B41M 7/0045* (2013.01); *B41M 7/0054* (2013.01); *B41M 7/0081* (2013.01); *B44C 3/02* (2013.01); *B05D 5/061* (2013.01); *B44C 5/04* (2013.01); *B44F 1/02* (2013.01); *B44F 9/02* (2013.01); *B44F 11/04* (2013.01); *E04F 13/0873* (2013.01); *E04F 15/107* (2013.01)

(58) Field of Classification Search

CPC ..... B05D 1/02; B05D 7/534; B05D 3/12; B05D 3/007; B05D 3/107; B05D 1/28; B05D 5/06; B05D 3/02; B05D 3/0254; B05D 3/0263; B05D 3/065; B05D 3/0413; B05D 3/002; B05D 3/0486; B05D 3/067; B05D 5/02; B05D 7/584; B05D 5/061; B41J 11/0015; B41J 11/002; B41F 23/08; B41M 3/06; B41M 5/0047; B41M 7/0027; B41M 7/0045; B41M 7/0054; B41M 7/0081; B44C 3/02; B44C 5/04; B44F 1/02; B44F 9/02; B44F 11/04; E04F 13/0873; E04F 15/107; E04F 15/02

See application file for complete search history.

(56) References Cited

U.S. PATENT DOCUMENTS

| | | | |
|---|---|---|---|
| 692,701 | A | 2/1902 | Burner |
| 3,308,227 | A | 3/1967 | Power et al. |

(Continued)

FOREIGN PATENT DOCUMENTS

| | | |
|---|---|---|
| CA | 2406991 | 11/2001 |
| CA | 2568440 | 12/2005 |

(Continued)

OTHER PUBLICATIONS

Barniz Entry in the Online Dictionary of the Spanish Language of the Real Academia, 3.P., Jun. 10, 2020.

(Continued)

*Primary Examiner* — William P Fletcher, III

(57) ABSTRACT

A method for producing a decorative and structured surface with different gloss levels by feeding of a workpiece to a lacquer application device, application of a first liquid lacquer layer over an entire surface with a coarse structure in which a difference in thickness between thicker areas and thinner areas is at least 50 μm, in order to apply a second lacquer layer on the first lacquer layer wherein after curing the second lacquer layer has a different gloss level than the first lacquer layer.

14 Claims, 3 Drawing Sheets

(51) Int. Cl.

| | |
|---|---|
| ***B44F 11/04*** | (2006.01) |
| ***E04F 13/08*** | (2006.01) |
| ***E04F 15/10*** | (2006.01) |
| ***B05D 5/06*** | (2006.01) |

(56) References Cited

U.S. PATENT DOCUMENTS

| | | | | |
|---|---|---|---|---|
| 3,580,768 | A | 5/1971 | Kukla | |
| 3,676,963 | A | 7/1972 | Rice et al. | |
| 4,439,480 | A | 3/1984 | Sachs et al. | |
| 4,557,778 | A | 12/1985 | Held | |
| 4,668,765 | A | 5/1987 | Drawert et al. | |
| 5,178,928 | A | 1/1993 | Goto et al. | |
| 5,358,737 | A | 10/1994 | Muees et al. | |
| 6,120,845 | A | 9/2000 | Pease | |
| 6,150,009 | A | 11/2000 | Stecker | |
| 6,193,361 | B1 | 2/2001 | Wen | |
| 6,375,777 | B1 | 4/2002 | Sjolin et al. | |
| 6,589,357 | B1 | 7/2003 | Wandres | |
| 6,621,087 | B1 | 9/2003 | Bisges et al. | |
| 6,927,014 | B1 | 8/2005 | Figov | |
| 9,266,382 | B2 | 2/2016 | Schacht et al. | |
| 11,141,759 | B2 * | 10/2021 | Pankoke | B05D 3/12 |
| 2002/0061389 | A1 | 5/2002 | Brooker et al. | |
| 2003/0152715 | A1 | 8/2003 | Beck et al. | |
| 2003/0167717 | A1 | 9/2003 | Garcia | |
| 2004/0048171 | A1 | 3/2004 | Grabber et al. | |
| 2004/0241416 | A1 | 12/2004 | Tian et al. | |
| 2005/0255249 | A1 | 11/2005 | Schlatterbeck et al. | |
| 2006/0130421 | A1 | 6/2006 | Nollet et al. | |
| 2006/0163371 | A1 | 7/2006 | Veil | |
| 2007/0235410 | A1 | 10/2007 | Wong et al. | |
| 2008/0176039 | A1 | 7/2008 | Chen et al. | |
| 2008/0241481 | A1 | 10/2008 | Tokumoto et al. | |
| 2008/0280028 | A1 | 11/2008 | Albrecht et al. | |
| 2009/0225143 | A1 | 9/2009 | Fukui | |
| 2009/0246365 | A1 | 10/2009 | Ito et al. | |
| 2010/0092688 | A1 | 4/2010 | Serbutoviez et al. | |
| 2011/0067731 | A1 | 3/2011 | Satoh et al. | |
| 2011/0157272 | A1 | 6/2011 | Ikehata et al. | |
| 2012/0015107 | A1 | 1/2012 | Schacht et al. | |
| 2013/0065024 | A1 | 3/2013 | Aruga et al. | |
| 2013/0101796 | A1 | 4/2013 | Arzt et al. | |
| 2013/0286088 | A1 | 10/2013 | Ryberg et al. | |
| 2013/0286095 | A1 | 10/2013 | Wada et al. | |
| 2013/0341532 | A1 | 12/2013 | Lee et al. | |
| 2014/0017452 | A1 | 1/2014 | Pervan et al. | |
| 2014/0343687 | A1 | 11/2014 | Jennissen | |
| 2016/0009932 | A1 | 1/2016 | Jang et al. | |
| 2016/0114619 | A1 | 4/2016 | Schacht et al. | |
| 2016/0205965 | A1 | 7/2016 | Elejalde et al. | |
| 2016/0238774 | A1 | 8/2016 | Koike et al. | |
| 2016/0297223 | A1 | 10/2016 | Langenscheidt et al. | |
| 2016/0332479 | A1 | 11/2016 | Clement | |
| 2017/0081522 | A1 | 3/2017 | Adam et al. | |
| 2017/0333936 | A1 | 11/2017 | Gibson et al. | |
| 2018/0056671 | A1 | 3/2018 | Boniface | |
| 2020/0016627 | A1 * | 1/2020 | Pankoke | B05D 5/02 |
| 2020/0023662 | A1 | 1/2020 | Pankoke | |
| 2020/0346246 | A1 | 11/2020 | Pankoke | |
| 2020/0346395 | A1 | 11/2020 | Pankoke | |
| 2020/0346484 | A1 | 11/2020 | Pankoke | |
| 2020/0368777 | A1 | 11/2020 | Pankoke | |
| 2021/0268542 | A1 | 9/2021 | Pankoke | |
| 2021/0394232 | A1 | 12/2021 | Pankoke | |

FOREIGN PATENT DOCUMENTS

| | | | | |
|---|---|---|---|---|
| CN | 1166386 | | 12/1997 | |
| CN | 1572380 | | 2/2005 | |
| CN | 1653390 | | 8/2005 | |
| CN | 101301821 | | 11/2008 | |
| CN | 101342844 | | 1/2009 | |
| CN | 102089088 | | 6/2011 | |
| CN | 102256806 | | 11/2011 | |
| CN | 102834188 | | 12/2012 | |
| CN | 103035983 | | 4/2013 | |
| CN | 103192656 | | 7/2013 | |
| CN | 103209770 | | 7/2013 | |
| CN | 103737464 | | 4/2014 | |
| CN | 104039368 | | 9/2014 | |
| CN | 105377521 | | 3/2016 | |
| CN | 105835589 | | 8/2016 | |
| DE | 3107798 | | 9/1982 | |
| DE | 3331391 | | 3/1985 | |
| DE | 69119743 | | 1/1997 | |
| DE | 19810455 | | 9/1999 | |
| DE | 69709984 | | 9/2002 | |
| DE | 10316695 | | 10/2004 | |
| DE | 60007560 | | 12/2004 | |
| DE | 102006003798 | | 7/2007 | |
| DE | 10 006042063 | | 3/2008 | |
| DE | 102007019871 | | 10/2008 | |
| DE | 102007055053 | | 5/2009 | |
| DE | 102008024149 | | 12/2009 | |
| DE | 102009004482 | | 7/2010 | |
| DE | 102009043812 | | 3/2011 | |
| DE | 102009044802 | | 12/2011 | |
| DE | 102009044802 | A1 * | 12/2011 | B41M 5/0064 |
| DE | 102010052518 | | 5/2012 | |
| DE | 102015107259 | | 11/2016 | |
| DE | 102015110236 | | 12/2016 | |
| DE | 102015110268 | | 12/2016 | |
| DE | 102016120878 | | 5/2017 | |
| DE | 102017113035 | | 12/2018 | |
| DE | 4421559 | | 5/2020 | |
| EP | 0019221 | | 11/1980 | |
| EP | 0197267 | | 10/1986 | |
| EP | 0210620 | | 2/1987 | |
| EP | 0810039 | | 12/1997 | |
| EP | 1101542 | | 5/2001 | |
| EP | 1384595 | | 1/2004 | |
| EP | 1482085 | | 12/2004 | |
| EP | 1652686 | | 5/2006 | |
| EP | 1685974 | | 8/2006 | |
| EP | 1872959 | | 1/2008 | |
| EP | 1902849 | | 3/2008 | |
| EP | 2050514 | | 4/2009 | |
| EP | 1290290 | | 1/2010 | |
| EP | 2174772 | | 4/2010 | |
| EP | 2181860 | | 5/2010 | |
| EP | 2251205 | | 11/2010 | |
| EP | 2280130 | | 2/2011 | |
| EP | 2301762 | | 3/2011 | |
| EP | 2308682 | | 4/2011 | |
| EP | 2418019 | | 2/2012 | |
| EP | 2786807 | | 10/2014 | |
| EP | 2857221 | | 4/2015 | |
| EP | 2873535 | | 5/2015 | |
| EP | 2873536 | | 5/2015 | |
| EP | 2883712 | | 6/2015 | |
| EP | 3090882 | | 11/2016 | |
| EP | 3109056 | | 12/2016 | |
| EP | 3109056 | A1 † | 12/2016 | |
| EP | 2555878 | | 12/2017 | |
| EP | 3415316 | | 12/2018 | |
| EP | 3415317 | | 12/2018 | |
| EP | 3415318 | | 12/2018 | |
| EP | 3415319 | | 12/2018 | |
| EP | 3466677 | | 4/2019 | |
| EP | 2313281 | | 9/2020 | |
| EP | 3875248 | | 9/2021 | |
| ES | 1018178 | | 1/1992 | |
| ES | 2340456 | | 6/2010 | |
| ES | 2349527 | | 1/2011 | |
| ES | 2586981 | | 10/2016 | |
| FR | 2936965 | | 4/2010 | |
| FR | 2946959 | | 12/2010 | |
| GB | 1405643 | | 9/1975 | |
| JP | 59-169575 | | 9/1984 | |
| JP | 06-270372 | | 9/1994 | |
| JP | 2003-285000 | | 10/2003 | |
| JP | 2004-134760 | | 4/2004 | |
| JP | 2010-069684 | | 4/2010 | |

(56) References Cited

FOREIGN PATENT DOCUMENTS

| | | | |
|---|---|---|---|
| JP | 2011-173091 | | 9/2011 |
| KR | 2010-0120434 | | 11/2010 |
| RU | 2005132339 | | 4/2007 |
| WO | WO 90/015673 | | 12/1990 |
| WO | WO 99/012736 | | 3/1999 |
| WO | WO 99/67227 | | 12/1999 |
| WO | WO 00/30856 | | 6/2000 |
| WO | WO 02/008346 | | 1/2002 |
| WO | WO 02/033740 | | 4/2002 |
| WO | WO 02/068189 | | 9/2002 |
| WO | WO 2003/099456 | | 12/2003 |
| WO | WO 2005/116361 | | 12/2005 |
| WO | WO 2006/037644 | | 4/2006 |
| WO | WO 2007/026172 | | 3/2007 |
| WO | WO 2008/110883 | | 9/2008 |
| WO | WO 2008/132126 | | 11/2008 |
| WO | WO 2010/070485 | | 6/2010 |
| WO | WO 2010/079014 | | 7/2010 |
| WO | 2011064075 | A2 † | 6/2011 |
| WO | WO 2011/064075 | | 6/2011 |
| WO | WO 2011/126148 | | 10/2011 |
| WO | WO 2014/184418 | | 11/2014 |
| WO | WO 2015/078449 | | 6/2015 |
| WO | WO 2016/014617 | | 1/2016 |
| WO | WO 2016/142510 | | 9/2016 |
| WO | WO 2017/204361 | | 11/2017 |
| WO | WO 2018/069874 | | 4/2018 |
| WO | WO 2020/039361 | | 2/2020 |

OTHER PUBLICATIONS

Emmler "Neue Entwicklungen bei der Industriellen Beschichtung von Holz und Holzwerkstoffen fuer Innenanwendungen", Technische Universitaet Dresden, Fakultaet Maschinenwese, Institut fuer Holz— und Papiertechnik, Tagungsband des 14. Holztechnologischen Kolloquiums, Dresden, Germany, Apr. 8-9, 2010, Schriftenreihe Holz- und Papiertechnik, 5: 120-125, Apr. 8, 2010.
Von Aufschnaiter "Industrial Ceramic Tile Manufacturing", Durst Phototechnik, Slideshow, p. 1-18, Nov. 3, 2014.
Official Action dated Aug. 27, 2020 from the US Patent and Trademark Office Re. U.S. Appl. No. 16/494,307. (26 pages).
Restriction Official Action dated Apr. 26, 2021 from the US Patent and Trademark Office Re. U.S. Appl. No. 16/494,308. (6 pages).
Official Action dated Oct. 18, 2021 from the US Patent and Trademark Office Re. U.S. Appl. No. 16/865,355. (56 pages).
Wikipedia "Ultraviolet", Wikipedia, the Free Encyclopedia, 29 P., Jun. 12, 2017.
Wikipedia "UV Curing", Wikipedia the Free Encyclopedia, 3 P. Apr. 12, 2017.
International Search Report and Written Opinion dated Sep. 3, 2018 From the International Searching Authority Re. Application No. PCT/EP2018/065731 and its English Translation. (16 Pages).
Beuth "Paints and Varnishes—Determination of Gloss Value at 20°, 60° and 85° (ISO 2813:2014); German Version EN ISO 2813:2014", Beuth Publishing DIN, 2 P., Feb. 2015.
Official Action with Third-Party Submission dated Sep. 10, 2021 From the US Patent and Trademark Office Re. U.S. Appl. No. 16/494,308. (50 Pages).
Restriction Official Action dated Jul. 7, 2021 from the US Patent and Trademark Office Re. U.S. Appl. No. 16/865,355. (6 pages).
Final Official Action dated Feb. 18, 2021 From the US Patent and Trademark Office Re. U.S. Appl. No. 16/494,307. (21 Pages).
Third Party Submission under 37 CFR 1.290 filed on Jan. 29, 2021 From the US Patent and Trademark Office Re. U.S. Appl. No. 16/494,308. (2 Pages).
Third-Party Submission Under 37 CFR 1.290 filed Jan. 29, 2021 From the US Patent and Trademark Office Re. U.S. Appl. No. 16/494,310. (2 Pages).
USPTO Communication dated Feb. 3, 2021 RE Third-Party Submission From the US Patent and Trademark Office Re. U.S. Appl. No. 16/494,308.(2 Pages).
USPTO Communication dated Feb. 3, 2021 RE Third-Party Submission From the US Patent and Trademark Office Re. U.S. Appl. No. 16/494,310.(2 Pages).
Wikipedia "Inkjet Printing", Wikipedia, p. 1-15, Last Edited Aug. 31, 2020.
Ezzeldin et al. "Improving the Performance of an Inkjet Printhead Using Model Predictive Control," Preprints of the 18th IFAC World Congress, Sep. 2, 2011: 11544-11549.
Final Official Action dated Mar. 18, 2022 from US Patent and Trademark Office Re. U.S. Appl. No. 16/865,355. (24 pages).
Final Official Action dated Feb. 7, 2022 fromUS Patent and Trademark Office Re. U.S. Appl. No. 16/494,308. (17 pages).
Wijshoff "The Dynamics of the Piezo Inkjet Printhead Operation", Physics Report, 491(4-5): 77-177, Available Online Mar. 31, 2010.
Third Party IDS Submission under 37 CFR 1.290 filed on Nov. 4, 2021 From the US Patent and Trademark Office Re. U.S. Appl. No. 16/865,356.(3 Pages).
Third Party IDS Submission under 37 CFR 1.290 filed on Oct. 15, 2021 From the US Patent and Trademark Office Re. U.S. Appl. No. 16/865,355.(2 Pages).
Third Party Submission under 37 CFR 1.290 filed on Nov. 28, 2021 From the US Patent and Trademark Office Re. U.S. Appl. No. 16/865,358.(3 Pages).
USPTO Communication dated Dec. 1, 2021 RE Third-Party Submission From the US Patent and Trademark Office Re. U.S. Appl. No. 16/865,358.(2 Pages).
USPTO Communication dated Nov. 10, 2021 RE Third-Party Submission From the US Patent and Trademark Office Re. U.S. Appl. No. 16/865,356.(2 Pages).
USPTO Communication dated Oct. 25, 2021 RE Third Party Submission From the US Patent and Trademark Office Re. U.S. Appl. No. 16/865,355.(2 Pages).
Notice of Allowance dated Apr. 21, 2022 from US Patent and Trademark Office Re. U.S. Appl. No. 16/494,308. (16 pages).
Notice of Allowance dated Jun. 7, 2022 from US Patent and Trademark Office Re. U.S. Appl. No. 16/865,355. (9 pages).
Restriction Official Action dated May 27, 2022 from the US Patent and Trademark Office Re. U.S. Appl. No. 16/494,310. (10 pages).

* cited by examiner
† cited by third party

METHOD AND APPARATUS FOR PRODUCING A DECORATIVE SURFACE

RELATED APPLICATIONS

This application is a National Phase of PCT Patent Application No. PCT/EP2018/065731 having International filing date of Jun. 13, 2018, which claims the benefit of priority of German Patent Application Nos. 10 2017 113 035.7 and 10 2017 113 036.5, both filed on Jun. 13, 2017, and European Patent Application Nos. 18157511.9 filed on Feb. 19, 2018, 18161725.9 filed on Mar. 14, 2018, 18162382.8 filed on Mar. 16, 2018 and 18168263.4 filed on Apr. 19, 2018. The contents of the above applications are all incorporated by reference as if fully set forth herein in their entirety.

FIELD AND BACKGROUND OF THE INVENTION

The present invention concerns a method and an apparatus for producing a decorative surface.

A decorative surface for furniture, floor panels or wall panels is state of the art. Surfaces of workpieces, such as chipboards or MDF boards, are coated with a decoratively printed paper or printed directly after application of a white primer and provided with a protective lacquer. The surfaces are often replicas of real wood surfaces, stones or tiles. Both the image (decoration) of the corresponding surfaces and the tactile "haptic" structure (tactile wood pores and knotholes or cracks or small holes, recesses in the stone) are reproduced. The surfaces that are coated can (also for the purposes of the present invention) be rolled goods such as printed paper or printed plastic foils. Likewise, a metal sheet from the roll (e.g. so-called coil material) can also be coated in the sense of the invention presented here.

The optical reproduction of decorative images is produced according to the state of the art using both analogue printing processes and digital printing processes based on a digital image template. To create the haptic, tactile structure with a structure depth of usually 5 to 500 μm, preferably 10 to 100 μm, an analogue process, such as embossing with structured embossed plates ("matrices"), is used according to the state of the art. Alternatively, embossing rollers or structured paint application rollers are also used.

DE 10 2007 055 053 A1 discloses a method for processing a structured surface of an embossing tool ("matrice"), whereby the gloss level of a first coating differs from that of a second coating, for example to better simulate wood pores. When such an embossing tool is subsequently used to produce a finished product, e.g. a floor panel, consisting of an HDF backing board and a printed, melamine-impregnated paper as decorative layer, after pressing with the embossing tool the wood pores printed decoratively in the paper become visible against light at an optical viewing angle of less than 45 degrees, also by differences in the gloss level of the cured melamine surface, moulded from the differently processed surface of the matrice. The production of such an embossing tool is a complex process. These embossing tools are usually used in short-cycle presses, in which the change from one embossing tool to another one takes longer time, at least approx. 15 to 30 minutes.

SUMMARY OF THE INVENTION

It is therefore an objective of this invention to create an optically and haptically appealing surface and to achieve a quick change from one surface to the next without wasting time and without the high costs of producing a special embossing tool. Furthermore, it was an objective to solve the problem of spatially matching the optical and haptic properties of the surface, e.g. to be able to arrange a glossy pore exactly above the optically printed wood pore. A tolerance of less than 2 mm, preferably less than 1 mm, between the decorative image and the haptic "pore" (hereinafter referred to as "synchronous structure") is to be understood as "spatially matching".

This problem is solved by the subject matter of the independent claims. Advantageous embodiments are subject of the subclaims.

According to the invention, a method is provided for producing a decorative and structured surface having different gloss levels, wherein a workpiece is fed to a laqquer application device, a first liquid lacquer layer, preferably over the entire surface, with a coarse structuring is applied, in which a difference in thickness between thicker areas and thinner areas is preferably at least 50 μm, particularly preferably at least 100 μm. In addition, droplets are sprayed, in particular digitally, on partial areas of the first lacquer layer on the workpiece with a preferably at least partially transparent lacquer to apply a second lacquer layer onto the first lacquer layer. After curing, the second lacquer layer has a different gloss level than the first lacquer layer.

Furthermore, the applied lacquer layers are preferably cured at least partially. This preferably takes place by physically drying and/or chemically curing at least one applied lacquer layer.

Preferably the workpiece is fed to a digital printing station in order to carry out the especially digital spraying of the droplets.

Preferably digital control data are provided for the digital printing station. These can, for example, be configured in such a way that the droplets are sprayed in accordance with a decorative pattern, which is located on the workpiece or on one of the applied lacquer layers. The control data are preferably obtained from a digitized version of the decorative image, in particular from an image file.

Preferably, a further method step is envisaged in which the first lacquer applied is at least partially cured.

Preferably, a further method step is envisaged in which a third liquid, preferably at least partially transparent lacquer layer is applied over at least partial areas of the workpiece or the applied lacquer layers to produce a fine structuring in certain areas. Preferably, a synchronous structure is formed with a decorative image underneath.

The workpiece is preferably printed with a decorative image before the method is carried out.

Preferably, a further method step is envisaged in which at least one of the applied lacquer layers and/or the workpiece itself is printed with a decorative image, preferably using at least two different colours.

Preferably, the digital print data available for the decorative image are used as a basis for the provided digital control data in identical form or in a form modified by a digital manipulation method.

Preferably, the first lacquer is applied with at least one printing roller, which unrolls on a surface of the workpiece or on a layer applied to the workpiece, in particular a base layer.

The printing roller is preferably designed to transfer a coarse structure to the first lacquer layer or the base layer. This can be done by embossing, for example. Preferably a structured roller can also be used, which transfers higher layer thicknesses in some areas than in others.

Preferably, the at least one base layer or the first lacquer layer has a coarse structure with a difference in thickness between thicker areas and thinner areas of at least 50 μm, preferably at least 80 μm, especially preferably at least 125 μm.

The tangible impression of a comparatively "deep" structure, i.e. with depressions or elevations of more than 100 μm, should preferably be represented without the exact synchronous structure being necessary for a realistic impression of the viewer with the particularly deep parts of the surface. Therefore, the requirements for the production process of the comparatively "deep" structure are preferably not as high as the requirements for the production of a spatially matching structure as described above.

Preferably, the second lacquer and/or the third lacquer is applied by at least one digital print head.

To form the third lacquer layer, preferably a liquid lacquer is applied first and then droplets of the third lacquer layer are sprayed into the, preferably still liquid, particularly preferably partially liquid or partially cured, material to form a fine structure.

The liquid lacquer can be the first or second lacquer layer, for example, or a separate lacquer layer can be applied for this purpose.

Structuring can be achieved by varying the impact speed and/or the mass or volume of the droplets in such a way that they penetrate either completely or partially into the lacquer layer and thereby create depressions in the lacquer layer. Depending on the impulse of the impacting droplet, an accumulation of displaced lacquer around the resulting depression can also be achieved. Furthermore, the droplets can also be applied to the lacquer layer in such a way that they do not or only slightly sink into the lacquer layer, so that they form, at least partially, a structure which is located on the lacquer layer or has only partially sunk into it. The method is designed in such a way that each droplet can be applied to the lacquer layer at different impact speeds and/or mass or volume.

Preferably, the paint droplets of the second or third lacquer layer consist of a different material than the liquid lacquer to which they are applied.

After impact, the paint droplets of the second or third lacquer layer preferably undergo a chemical reaction with the liquid lacquer, which reaction changes the surface optically and/or haptically at the respective areas.

Preferably the lacquer droplets of the second or third lacquer layer volatilize due to a physical reaction after impact on the liquid lacquer, preferably within less than five minutes by evaporation, preferably within less than one minute.

Preferably, at least one of the lacquers used or one of the applied lacquer layers consists of an at least partially transparent lacquer, so that a decorative image, in particular arranged below, can be optically recognized through the two lacquer layers.

It is particularly preferred to envisage further steps, which involve the application of at least one intermediate layer between the workpiece and the first lacquer layer.

Preferably the drying and/or curing takes place by means of an electromagnetic radiation source, preferably at a wavelength of 172 nm, especially preferably by means of an excimer lamp, and/or an electron beam source, and/or an UV light source, and/or an IR light source, and/or a blower which blows air onto the workpiece or its lacquer layers, whereby the air is preferably heated relative to the ambient air, especially preferably by at least 10° C.

The disclosed method is not limited to the order of the method steps shown. Rather, further methods can be obtained that also fall within the claimed scope of protection by exchanging, supplementing or repeating individual steps. For example, the third lacquer layer can also be applied before the second lacquer layer. The designation of the lacquer layers as "first", "second" and "third" lacquer layers therefore serves only to distinguish between the individual lacquer layers and must not be understood in the sense of a processing or application sequence.

According to the invention, an apparatus for carrying out the above mentioned method is also provided comprising a station for applying paint and a device for feeding the workpiece to the station for applying paint. It comprises a first printing station which is configured for the application of a first liquid lacquer over the entire surface of the workpiece, whereby the first liquid lacquer has a coarse structure. Furthermore, a second, especially digital, printing device is envisaged, which is configured to apply a second lacquer layer to the first lacquer layer.

Furthermore, a station is preferably provided for at least partially curing the applied lacquer layers, in particular the first and second lacquer layers.

Preferably, the second, especially digital, printing device is also configured to apply a liquid, at least partially transparent, lacquer layer to create a fine structure in specific areas.

Alternatively or additionally, the apparatus also comprises a station for the application, in particular digital application, of a third liquid, at least partially transparent lacquer layer for creating a fine structuring in specific areas.

Preferably, at least one printing roller is also provided, which unrolls on a surface of the workpiece and is preferably configured to apply a coarse structure to the first lacquer layer.

At least one electromagnetic radiation source, in particular an excimer lamp, preferably with a wavelength of 172 nm, is also preferably provided for the, preferably complete, curing and/or drying of at least one applied lacquer. Furthermore, an IR and/or UV light source and/or an electron beam source is preferably provided. Furthermore, a blower is preferably provided, which is configured to blow air onto the workpiece, especially onto the applied lacquer layers.

Furthermore, a station which is preferably constructed for applying at least one liquid base layer and/or a station which is constructed for structuring at least one base layer is envisaged.

The apparatus according to the invention is not limited to the features described above. Rather, further apparatuses can be formed which also fall within the claimed scope of protection, for example by providing several features equivalent to the above-described features, or by changing their order of arrangement. For example, the stations for applying the second and third lacquer layers can also be identical.

The second lacquer layer provides the surface of the workpiece with different gloss levels, so that the gloss level can preferably be matched to a decorative image arranged underneath. By digitally applying the second lacquer layer, the gloss level on the surface can be individually matched depending on the digital printing template, whereby successive workpieces with different gloss levels in different areas can be printed without the need to change a matrice or another tool.

The gloss level of individual lacquer layers preferably deviates from each other by at least 10 gloss units, preferably at least 20 gloss units, whereby the gloss units are measured according to DIN EN ISO 2813:2015-02 at an angle of 60°. As a result, an optically clearly perceptible difference in gloss becomes visible. The gloss level can be varied by the droplet size and/or the number of droplets per area or by the use of matting agents.

Gloss is measured according to DIN EN ISO 2813:2015-02. For the gloss measurement, the amount of light reflected by a surface in relation to a reference standard from polished glass is measured. The unit of measurement used here is GU (Gloss Units). The amount of light reflected from the surface depends on the angle of incidence and the properties of the surface. For gloss measurement, different angles of incidence (20°, 60° and 85° can be used to measure the reflectance, preferably at an angle of incidence of 60°. Alternatively, the mean value of measurements for the three angles of incidence can also be used. The reflectance compares the light energy emitted from and received by a gloss meter in percent at a certain angle of incidence.

All surfaces or sections of surfaces which, according to the standard, achieve less than 20 gloss units when measured with a gloss meter are defined as "matte", and all surfaces or sections of surfaces which achieve more than 60 gloss units are referred to as "glossy". Individual lacquer layers can be matte and others glossy.

The surfaces of individual lacquer layers can be smooth or structured. With a structured surface, the gloss is measured and the definition of the distinction between "matte" and "shiny" sub-areas used here is the same as for non-structured surfaces. For example, a structured surface of the workpiece can have a structure depth of 5 to 300 μm (micrometers), preferably 10 to 90 μm (micrometers).

For a fine adjustment of the gloss level, the droplets of the second lacquer layer are preferably sprayed with a droplet size smaller than 100 pL (picoliter), in particular smaller than 10 pL (picoliter). Optionally, different gloss levels can also be applied to the second lacquer layer, so that differences in gloss can also be present within the second lacquer layer.

With the first lacquer layer, a colored decorative image can be printed in the analog method, for example using printing rollers, or by digital print heads. Alternatively or additionally, a transparent lacquer layer can be applied with the first lacquer layer to an existing decorative image.

To produce a structured surface in a production line, a liquid base layer can be applied to a surface of a coated or uncoated workpiece and a structure can be applied to the still liquid base layer using digital print heads or other structuring agents in order to subsequently fix the structured base layer. Optionally, the structured base layer can then form the first lacquer layer or a first lacquer layer is then applied to the structured base layer. For a special optical effect, only the areas with a structure or only the areas without a structure can be printed with the second lacquer layer. This allows an essentially congruent arrangement of structured areas and glossy or matte areas.

A third liquid, at least partially transparent, lacquer is now applied to the applied lacquer layers with coarse structuring and preferably visible decor to create a fine structuring in certain areas. This third lacquer is then preferably cured, whereby the difference in thickness in the area of fine structuring of the third lacquer layer is preferably smaller than 50 μm, in particular smaller than 30 μm, for example between 5 μm and 25 μm. As a result, the visible decor is coated with at least two lacquer layers that produce different structures on the surface, coarse structuring with greater differences in thickness and fine structuring with smaller differences in thickness. This makes the surface less uniform visually and haptically.

Preferably, the gloss level in the area of fine structuring differs by at least 10 gloss units compared to the area of coarse structuring. The gloss level of the first and/or second lacquer layer can preferably deviate by at least 20 gloss units from the gloss level of the third lacquer layer, whereby the gloss units are measured according to DIN EN ISO 2813:2015-02 at an angle of 60°. As a result, an optically clearly perceptible gloss effect becomes visible. The gloss level can be varied during printing by the droplet size and/or the number of droplets per area or by the use of matting agents.

The first lacquer is preferably applied with at least one printing roller, which unrolls on one surface of the workpiece. For example, the printing roller can be engraved and have an elastic material on an outer surface or an inner ring. Then the engraved roller can unroll directly on the surface of the workpiece. Alternatively, the first lacquer can be applied via at least two rollers, whereby the first lacquer is transferred from a first roller to a second application roller, which then transfers the first lacquer to the surface of the workpiece.

The third lacquer for producing the fine structuring is preferably applied by at least one digital print head. As a result, an optical area of a decorative image can be spatially arranged to match its haptic properties particularly precisely. For example, a fine structuring can be used to imitate a subtle wood grain, which is arranged congruently to a wood grain in the decorative image.

Alternatively or additionally, the third lacquer can also be applied after an initially liquid lacquer has been applied, whereby droplets of the third lacquer layer are then sprayed into the still liquid material to produce a fine structuring. The lacquer droplets can consist of the same material as the liquid layer. For example, a plurality of lacquer droplets is applied to the still liquid lacquer layer by means of digital print heads using lacquer droplets with a volume of less than 10 pL, which are sprayed at a speed greater than 1 m/s onto the still liquid lacquer.

In an alternative embodiment, the lacquer droplets are made of a different material than the liquid lacquer and undergo a chemical reaction with the liquid lacquer after impact, which changes the surface optically or haptically in these areas. Instead of a chemical reaction, the liquid lacquer can also cause a physical reaction by impingement on the liquid lacquer, whereby the sprayed droplets volatilize within less than five minutes, preferably within less than one minute, by evaporation.

The method is preferably used for plate-shaped workpieces, in particular made of a wood-based material or a plastic sheet. Alternative embodiments can also be mixed wood/plastic plates, e.g. so-called WPC plates, or plastic-mineral mixtures, e.g. "filled plastics". PP, PE, PVC and other plastics are also suitable, for example. However, in an alternative embodiment it is also possible to coat rolled goods instead of a plate-shaped workpiece. These include, for example, decorative printed paper or plastic film made of ABS, PP, PE or similar materials. The paper can have a basis weight between 20 g/m$^2$ and 300 g/m$^2$. The plastic films can be from 0.05 mm to 5 mm thick. The rolled goods include, for example, edge bands that are fixed to the front sides of panel-shaped workpieces in the production of furniture panels.

BRIEF DESCRIPTION OF THE SEVERAL VIEWS OF THE DRAWINGS

Below is a description of preferred embodiments of the invention with the aid of the accompanying drawings. In detail.

DESCRIPTION OF SPECIFIC EMBODIMENTS OF THE INVENTION

Figure 1:
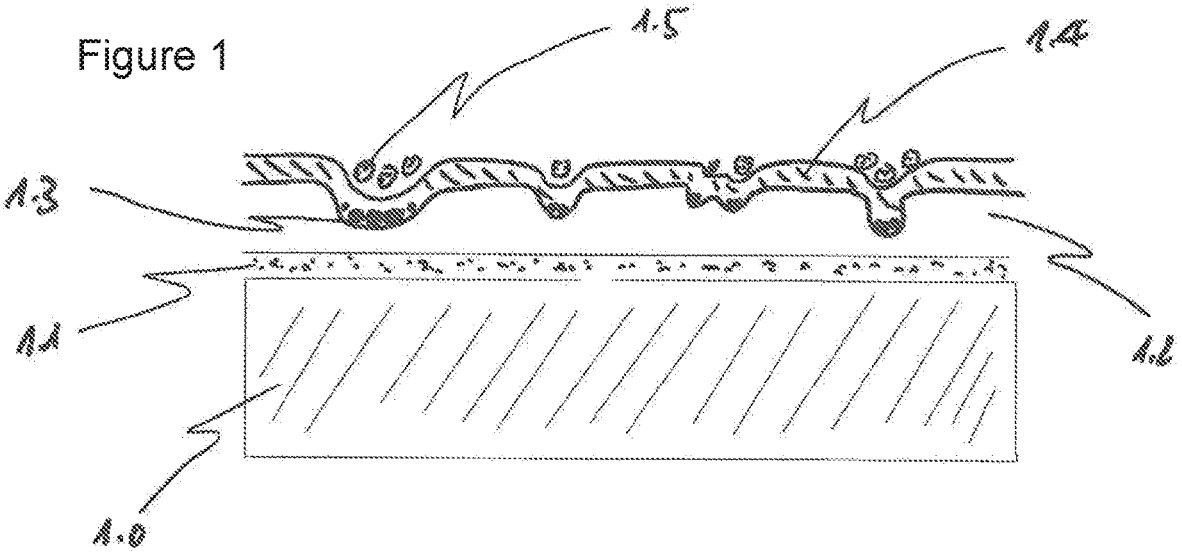
FIG. 1 is a schematic cross-sectional view of a plate-shaped workpiece produced by means of the method of the invention.

FIG. 1 shows a plate-shaped workpiece 1.0 on which an optional first base layer 1.1 is provided on one surface. In addition, a decorative image, e.g. a wood reproduction or a tile image, is optionally printed on the workpiece 1.0 before the first base layer 1.1 is applied.

In an alternative embodiment, a decorative image can also be printed on after application of the first base layer 1.1 or after application of a structured second base layer 1.2, for example using a single or multi-colour digital printer. Alternatively, the first base layer 1.1 can also be provided with a decorative image with several colours.

A second liquid base layer 1.2 is applied to the first base layer 1.1. This second base layer 1.2 has been structured with digitally sprayed droplets 1.3, so that the surface is no longer flat, but has a structure and forms a first lacquer layer with a coarse structuring. Then a first lacquer layer 1.4 is applied, which has a first gloss level.

A second lacquer layer 1.5 is then applied to the first lacquer layer 1.4 by droplet delivery via digital print heads to produce a fine structuring, whereby the second lacquer layer 1.5 only partially covers the surface of the first lacquer layer 1.4.

Coatings 1.4 and 1.5 are cured one after the other or together, for example by UV radiation. After curing, the second lacquer layer 1.5 has a different gloss level than the first lacquer layer.

Instead of structuring the second base layer 1.2 with digitally sprayed droplets 1.3, it is also possible to structure a base layer using other methods, for example by applying it only in certain areas or using embossing matrices, or using structured rollers that apply variable layer thicknesses. It is also possible to apply the decorative image to a structured surface instead of a flat surface.

Figure 2:
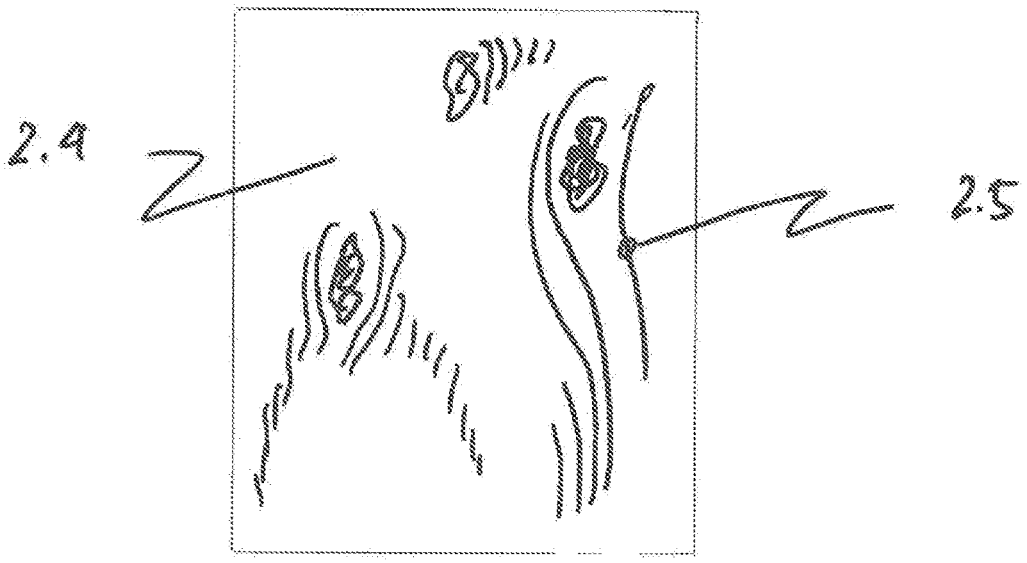
FIG. 2 is another schematic illustration of a plate-shaped workpiece produced by means of the method according to the invention with an indicated wood pore in plan view.

FIG. 2 shows a plan view of the plate-shaped workpiece 1.0 of FIG. 1 and it can be seen that the decorative image comprises a wood pore 2.5 and grained wood areas 2.4.

The different areas of the wood pore 2.5 and the grained wood areas 2.4 can also have a different gloss level due to the second lacquer layer 1.5, whereby the decorative areas of the image and the different gloss areas are preferably congruent due to the lacquer application.

In a further embodiment, a carrier plate made of a wood material, or a plastic plate, or a plate made of another material with a thickness of at least 4 mm, preferably 8 to 16 mm and external dimensions of at least 200 mm width and at least 400 mm length is first coated with a UV-curing, white base lacquer, for example with a quantity of about 20 g/qm. This white base lacquer is then cured under UV irradiation.

The carrier plate is then fed to a digital printing device in which a printed image, for example a reproduction of small tiles as mosaics, a wood decor or another pattern, for example with a four-colour CMYK print, is applied.

Figure 3:
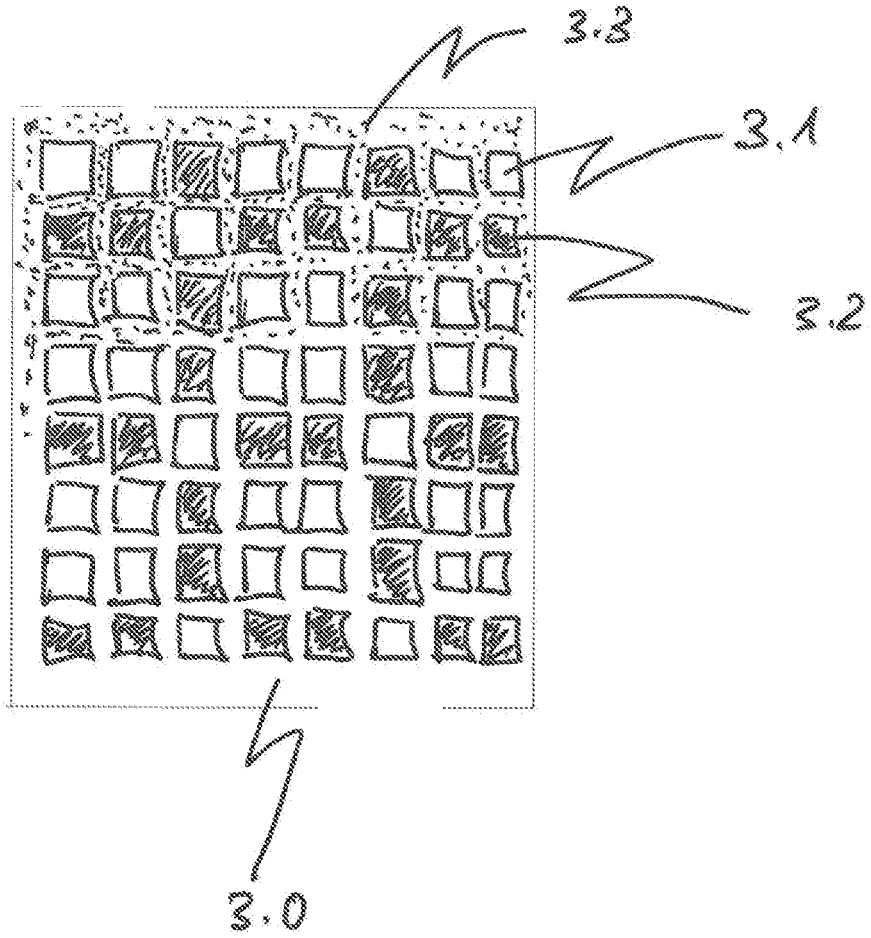
FIG. 3 is a surface of a printed workpiece.

FIG. 3 shows an example of a printed image with two mosaic tiles in different colours printed on a plate-like workpiece 3.0, whereby bright mosaic tiles 3.1 and darker mosaic tiles 3.2 are provided.

A variety of other colours of tiles or mosaics with pictorial representations can also be used in an alternative embodiment.

Then a thin base lacquer layer 1.1 of 5 to 15 g/sqm of a UV-curing lacquer is applied to the workpiece 3.0 printed in this way and (partially) cured with UV light. In an alternative embodiment, this base lacquer layer can be completely omitted or replaced by a solvent lacquer or an aqueous acrylate lacquer, which is then dried, for example physically.

A second base layer 1.2 is then applied to the first base layer 1.1 or alternatively directly to the printed image as a radiation-curing lacquer layer with coarse structuring, which is produced as described above, preferably on an acrylate basis, in a layer thickness of 100 to 500 μm. The base layer 1.2 can be applied by digital print heads or by printing rollers or other processes.

Directly after the application of this second base layer 1.2, a transparent lacquer layer consisting of droplets 1.3 is applied to the still liquid layer, optionally by means of a digital print template with digital print heads, before curing.

When applying these droplets 1.3 the droplet size can vary between 1 pL and 100 pL. The digital printing template used is the one that was also used to print the tile mosaic described above. This printing template is electronically modified beforehand so that only the interspaces 3.3 of the mosaic tiles 3.1 and 3.2 are printed so that recesses corresponding to a joint pattern are made in the second base lacquer layer 1.2. Then the radiation-curing base lacquer layer 1.2 is cured together with the droplets 1.3 by a UV lamp. In an alternative embodiment, curing can also be performed using electron radiation.

The result is a carrier plate printed with a tile mosaic in which the interspaces 3.3 are recessed by 10 μm to 60 μm as joints between the mosaic tiles 3.1 and 3.2.

Subsequently, the gloss level of at least parts of the entire surface is adjusted to the desired value by at least partial application of a first lacquer layer 1.4 with subsequent drying, whereby the gloss level of the sprayed droplets 1.3 deviates from the gloss level of the second lacquer layer 1.4.

In an alternative embodiment, the additional application of a third lacquer layer 1.5 can also be carried out before or after the second lacquer layer 1.4 has cured, whereby the third lacquer layer 1.5 also consists of a large number of droplets with a size of 3 to 100 pL dispensed onto the surface. With this third lacquer layer, both the gloss level can be changed again in some areas and the surface structure depth of the uncured lacquer layer 1.4 can be influenced.

The lacquer layers 1.4 and 1.5 can also be completely omitted if the gloss level is changed by applying the first lacquer layer 1.3 concomittantly with application of the second base lacquer layer 1.2 for structuring.

The surface of the mosaic tiles 3.1 and 3.2 now has a value of 60 to 90 gloss units, for example, while the gloss level at the interspaces 3.3 is only 20 to 40 gloss units, for example.

Optionally, the gloss level at the interspaces 3.3 can also be reduced by a further lacquer layer, which is subsequently printed into the recessed interspaces by a further digital printing device with a transparent, UV-curing lacquer. Then more than just two lacquer layers are applied to adjust the gloss level.

For printing a rather matte lacquer layer, droplet sizes of 3 to 6 pL are used, which are cured within 0.5 to 2 seconds after impact on the surface by means of UV LED radiation to such an extent that they can no longer flow. This creates a surface structure in these areas that no longer reflects the incident light in a straight line. The gloss level is thereby reduced to values of 30 gloss units or less, preferably to 15 gloss units or less.

In the method of the invention, the second lacquer layer can have either a higher or lower gloss level than the first lacquer layer. The gloss level can be adjusted using the following methods, for example:

Option 1:

Matte areas through the first lacquer layer consist of previously (analog or digital) applied matte lacquer, for example with matting agents or by an excimer matting.

Glossy areas of the second lacquer layer consist of lacquer applied by digital print heads, which lacquer is formed from a plurality of individual droplets, which results in a very smooth surface in certain areas and thus a high gloss level.

The droplets have a size of at least 6 pL, and curing only takes place after a progression phase of at least 1 sec, preferably after more than 5 sec.

Option 2:

The glossy areas of the first lacquer layer consist of previously (analog or digital) applied glossy lacquer.

Matte areas of the second lacquer layer consist of digitally applied lacquer consisting of a plurality of smallest droplets having a droplet size of less than 8 pL, preferably less than 3 pL, which are at least partially cured within less than 3 seconds after application, preferably less than one second after application.

Both options preferably employ curing by a UV-LED lamp, which is arranged in the direction of throughput, for example within less than 100 mm after the digital print heads, which apply the plurality of droplets to the surface.

Matting agents, such as PE waxes or silicas, can be added to the lacquer to produce a matte lacquer layer. The proportion of matting agents in the lacquer can be between 2% to 6%, in particular 3% to 5% (weight percent).

The different Examples of FIGS. 1 to 3 can be combined with one another as desired with regard to the application and structuring of a layer. The number of layers on the workpiece can also be freely selected, depending on the surface structure to be created with the method.

In alternative embodiments of the method according to the invention, acrylate-containing, UV-curing lacquers used as the lacquers can be replaced by aqueous or solvent-based lacquers. In this case, the steps for UV drying by means of UV LED or UV arc lamp are replaced by physical drying by means of hot air or IR lamps or a combination of both.

Figure 4:
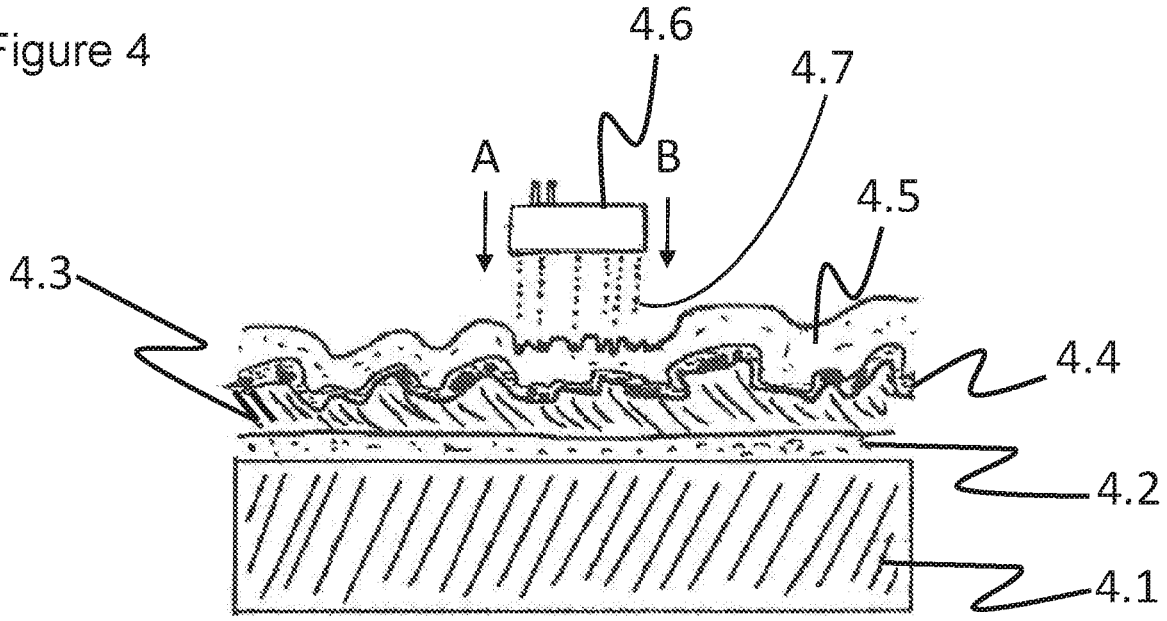
FIG. 4 is a view of a workpiece according to the invention having several layers.

FIG. 4 shows another example of a coated plate-shaped workpiece 4.1.

A workpiece 4.1, for example a panel made of a wood-based material with a width of 200 to 2000 mm and a length between 500 and 3000 mm as well as a thickness between 8 mm and 18 mm, is fed to a coating station. The workpiece 4.1 is already printed with a decorative image, such as a wood reproduction, e.g. an oak decor.

Alternatively, a plastic plate, a plate made of WPC, HDF, MDF, metal, in particular as coil material, can also be used as workpiece 4.1.

In the coating station, a smooth intermediate lacquer layer 4.2, such as an adhesive base or primer, is optionally applied. Subsequently, by means of a laser-engraved rubber roller, a radiation-curing, transparent first lacquer layer 4.3 of 100 to 200 g/m2 is applied to the workpiece 4.1, whereby the engraving in the rubber roller creates, for example, the structure of a coarse wood pore on the surface. Other structures are also possible, such as a tile finish.

The height differences between the "pore valleys" and the elevations, i.e. the thickness differences of the first lacquer layer 4.3, are between 50 μm and 300 μm (micrometers) and form a coarse structure. The applied lacquer is then cured with a UV lamp.

In an alternative embodiment, a decorative image 4.4 can be printed on the thus structured surface after curing using a digital printer with four-colour printing if no image was on the workpiece before the coating. In this case, the lacquer layer 4.3 may also be coloured, for example white. Otherwise, an existing image can be added or changed.

A further liquid lacquer layer 4.5 is applied to the now cured lacquer layer 4.3 with or without the coloured decorative printing layer 4.4 in a further coating station by means of a smooth rubber roller.

Then the workpiece 4.1 is fed to a digital printing station 4.6, where a plurality of droplets 4.7 are applied into the still liquid lacquer layer 4.5 according to a digital image template, which provide the still liquid lacquer layer 4.5 with a fine structure. The digital image template is matched to the previously printed decorative image, for example rustic oak, in such a way that the optically recognizable image details, such as a knot hole or a black printed crack in the wood, exactly spatially match the structure printed into the liquid pore. This allows the end user to feel the optically printed knothole. At the same time, the very deep and coarse structure of the lacquer layer 4.3, which emphasizes the rustic character of the oak reproduction, is located above.

Further aspects are explained below.

A first aspect is a method of producing a decorative surface with different gloss levels, comprising the following steps:

- Feeding of a workpiece 1.0 to a lacquer application device;
- Coating of the workpiece 1.0 with at least a first lacquer layer 1.4;
- Feeding of the workpiece to a digital printing station;
- Provision of digital control data for the digital printing station;
- Digital spraying of droplets on partial areas of the first lacquer layer 1.4 on the workpiece 1.0 with an at least partially transparent lacquer in order to apply a second lacquer layer 1.5 to the first lacquer layer 1.4, the second lacquer layer 1.5 having a different gloss level than the first lacquer layer 1.4 after the curing, and
- physical drying and/or chemical curing of the applied lacquer layers 1.4, 1.5.

A second aspect of the method described above is that the workpiece 1.0 is already printed with a decorative image before being fed to a lacquer application device, or that the workpiece 1.0 is printed with at least two different colours using a digital printer after being fed to a lacquer application device and before being coated with at least a first lacquer layer 1.4.

A third aspect of the method according to one of the two preceding aspects is that the digital print data available for the decorative image on the workpiece is used in identical form or in a form modified by a digital manipulation method as a basis for the digital data provided.

A fourth aspect of the method according to one of the three preceding aspects is that the lacquer layer 1.4 applied to coat the workpiece 1.0 is at least partially cured before the digital spraying of droplets by an additional method step.

A fifth aspect of the method according to one of the four preceding aspects is that the gloss level of the first lacquer layer 1.4 deviates by at least 10 gloss units, preferably at least 20 gloss units, from the gloss level of the second lacquer layer 1.5, wherein the gloss units are measured according to DIN EN ISO 2813:2015-02 at an angle of 60°.

A sixth aspect of the method according to one of the five preceding aspects is that during the digital spraying of the droplets, droplets with a droplet size smaller than 10 pL, in particular smaller than 6 pL, are sprayed.

A seventh aspect of the method according to one of the six preceding aspects is that the surface of the workpiece 1.0 has a structure with a structure depth of 5 to 300 μm (micrometer), preferably 10 to 90 μm (micrometer), before the second lacquer layer is applied.

An eighth aspect of the method according to one of the seven preceding aspects is that a transparent lacquer layer is applied to an existing decorative image with the first lacquer layer 1.4.

A ninth aspect of the method according to one of the eight preceding aspects is that a liquid base layer 1.2 is applied to a surface of the coated or uncoated workpiece 1.0 and a structure is introduced into the still liquid base layer 1.2 by means of digital print heads, which structure is subsequently fixed, wherein the structured base layer is the first lacquer layer 1.4 or the first lacquer layer 1.4 is applied to the structured base layer.

A tenth aspect of the method according to the ninth aspect is that only the areas provided with a structure or only the areas without a structure are printed with the second lacquer layer 1.5.

An eleventh aspect of the method according to one of the ten preceding aspects is that the two lacquer layers 1.4, 1.5 are applied from an at least partially transparent lacquer, so that a decorative image arranged below the two lacquer layers 1.4, 1.5 can be optically recognized therethrough.

A twelfth aspect of the method according to one of the eleven preceding aspects is that the second lacquer layer 1.5 produces a glossy or high-gloss surface or a matte or less glossy surface.

A thirteenth aspect of the method according to one of the twelve preceding aspects is that the first and/or second lacquer contains matting agents, preferably in a weight proportion between 2% and 6%, in particular between 3% and 5%.

A fourteenth aspect of the invention is an apparatus for carrying out the method according to one of the aspects described above, comprising a first printing device for applying a first lacquer layer 1.4 and a second digital printing device for applying a second lacquer layer 1.5 onto the first lacquer layer 1.4, wherein after curing the second lacquer layer 1.5 has a different gloss level than the first lacquer layer 1.4.

A fifteenth aspect is a method of producing a decorative work piece with a structured surface comprising the following steps:

Feeding of the workpiece to a coating station;

Application of a first liquid lacquer with a coarse structure, in which a difference in thickness between thicker areas and thinner areas is at least 50 μm, in particular at least 100 μm, over the entire surface;

at least partial hardening of the applied first lacquer;

Application of a decorative image by multicolour printing before the application of the first liquid lacquer or after at least partial curing of the applied first lacquer;

Application of a second liquid, at least partially transparent, lacquer to create a fine structure in certain areas;

Curing of the second lacquer, wherein the difference in thickness in the area of fine structuring on the second lacquer layer is less than 50 μm, in particular less than 30 μm.

A sixteenth aspect of the method according to the fifteenth aspect is that the gloss level in the area of fine structuring is different by at least 10 gloss units as compared to that of coarse structuring.

A seventeenth aspect of the method according to the fifteenth or sixteenth aspect is that the first lacquer is applied with at least one printing roller that unrolls on a surface of the workpiece.

An eighteenth aspect of the method according to any one of the fifteenth to seventeenth aspects is that the second lacquer is applied by at least one digital print head.

A nineteenth aspect of the method according to any one of the fifteenth to eighteenth aspects is that the material for the first and second lacquers is identical.

A twentieth aspect of the method according to one of the fifteenth to nineteenth aspects is that a liquid lacquer is first applied to produce the second lacquer layer and then droplets of the second lacquer layer are sprayed into the still liquid material to produce a fine structure.

A twenty-first aspect of the method described in the previous paragraph is that the lacquer droplets are made of the same material as the liquid layer and/or that a plurality of lacquer droplets are applied to the still liquid lacquer layer with digital print heads, wherein each lacquer droplet has a volume of less than 10 pL, and the speed of each lacquer droplet upon impingement on the still liquid lacquer layer is greater than 1 m/s.

An alternative aspect to the method described in the previous paragraph is that the lacquer droplets are made of a material other than the liquid lacquer and, after impact, undergo a chemical reaction with the liquid lacquer which changes the surface optically or haptically at the respective areas and/or volatilise according to a physical reaction by evaporation within less than five minutes after impact with the liquid lacquer.

Another aspect of the method according to one of the previous eight paragraphs is that at least one intermediate layer is applied between the workpiece and the first lacquer layer.

Another aspect of the invention is an apparatus for carrying out the method according to one of the preceding aspects, comprising:

- a coating station and a device for feeding the workpiece to the coating station;
- a first printing station for applying a first liquid lacquer over the entire surface of the workpiece with a coarse structuring, in which a difference in thickness between thicker areas and thinner areas is at least 50 μm, in particular at least 100 μm;
- a station for at least partial curing of the first lacquer;
- a station for applying a second liquid, at least partially transparent, lacquer for producing a fine structure in certain areas, and
- a station for curing the second lacquer, wherein the thickness difference in the area of the fine structuring on the second lacquer layer is less than 50 μm, in particular less than 30 μm.

The aspects and embodiments of the invention described herein do not restrict the subject matter of the invention. Rather, further subject-matter, which also fall within the scope of protection of this application, can be obtained by combining individual features of the embodiments and aspects.

LIST OF REFERENCE SIGNS

1.0 Workpiece
1.1 First base layer
1.2 Second base layer
1.3 Digitally sprayed droplets (third lacquer layer)
1.4 First lacquer layer
1.5 Digitally sprayed droplets (second lacquer layer)
2.4 Grained wood areas
2.5 Wood pore
3.0 Workpiece
3.1 Light-coloured mosaic tiles
3.2 Darker mosaic tiles
3.3 Interspaces
4.1 Workpiece
4.2 Intermediate lacquer layer, e.g. adhesive base/primer
4.3 Analogously applied structured lacquer
4.4 Digital decor printing
4.5 Liquid lacquer layer
4.6 Digital printing station
4.7 Droplets

What is claimed is:

1. A method for producing a decorative and structured surface element having different gloss levels, the method comprising:

feeding of a workpiece (1.0) to a lacquer application device, applying of a first liquid lacquer layer (1.4) over an entire surface of the decorative and structured surface element with a coarse structure in which a difference in thickness between thicker areas and thinner areas is at least 50 μm, spraying of droplets on partial areas of the first lacquer layer (1.4) on the workpiece (1.0), with a lacquer in order to apply a second lacquer layer (1.5) on the first lacquer layer (1.4), wherein after curing the second lacquer layer (1.5) has a different gloss level than the first lacquer layer (1.4) wherein the first lacquer layer (1.4) is applied with at least one printing roller which unrolls on a surface of the workpiece (1.0) or on a layer applied to the workpiece (1.0).

2. The method according to claim 1, further comprising:

coating of the workpiece (1.0) with at least one base layer (1.1, 1.2), and/or structuring of at least one base layer (1.1, 1.2), and/or at least partial curing of the first lacquer layer (1.4) applied, and/or at least partial application of a third liquid lacquer layer (1.3) in order to create a fine structure in certain areas.

3. The method according to claim 1, comprising:

feeding of the workpiece (1.0) to a digital printing station, and/or providing digital control data for the digital printing station, and/or curing of the applied first lacquer layers (1.4) and the second lacquer layer (1.5).

4. The method according to claim 2, wherein the workpiece (1.0) is printed with a decorative image before the method is carried out, and/or the at least one base layer (1.1, 1.2) or the first lacquer layer (1.4) has a coarse structure with a difference in thickness between thicker areas and thinner areas of at least 50 μm.

5. The method according to claim 1, comprising:

printing at least one of the applied first lacquer layer or second lacquer layer and/or the workpiece (1.0) with a decorative image.

6. The method according to claim 5, wherein digital print data available for the decorative image is used as a basis for digital control data provided for a digital printing station used for printing on the workpiece (1.0).

7. The method according to claim 1, wherein second lacquer layer (1.5) and/or a third lacquer layer (1.3) is applied by at least one digital print head.

8. The method according to claim 2, wherein to produce the third lacquer layer (1.3), liquid material is first applied and then droplets of the liquid material are sprayed over the entire surface to produce a fine structure.

9. The method according to claim 8, wherein the lacquer droplets applied consist of another material than the liquid lacquer, and/or after impact, undergo a chemical reaction with the liquid lacquer, which changes the surface optically and/or haptically at respective areas, and/or volatilise according to a physical reaction by evaporation within less than five minutes by impact with the liquid lacquer.

10. The method according to claim 1, wherein at least one of the first and second lacquer layers (1.4, 1.5) is applied from an at least partially transparent lacquer, so that a decorative image is optically recognizable through the lacquer layers (1.4, 1.5).

11. The method according to claim 1, wherein an intermediate layer is applied between the workpiece (1.0) and the first lacquer layer (1.4).

12. The method according to claim 1, wherein drying and/or curing is applied by:

an electromagnetic radiation source with a wavelength of 172 nm, and/or a UV light source, and/or an IR light source, and/or an electron beam source, and/or a fan that blows air onto the workpiece (1.0) or its lacquer layers.

13. An apparatus for carrying out the method according to claim 1, comprising:

a coating station and a device for feeding the workpiece (1.0) to the coating station;

a first printing station for applying a first liquid layer (1.4) over an entire surface onto the workpiece (1.0) with a coarse structure;

a second printing device for applying the second lacquer layer (1.5) to the first lacquer layer (1.4).

14. The apparatus according to claim 13, further comprising:

at least one station for at least partial curing of the first and second lacquer layers (1.4, 1.5)

a station for applying a third, liquid, at least partially transparent, lacquer layer in order to produce a fine structure in certain areas, and/or at least one printing roller that unrolls on a surface of the workpiece, and/or a station configured to apply at least one liquid base layer (1.1, 1.2), and/or a station configured to structure at least one base layer (1.1, 1.2), a station for drying and/or curing of at least an applied lacquer.

* * * * *